United States Patent [19]

Hasegawa

[11] Patent Number: 4,815,952

[45] Date of Patent: Mar. 28, 1989

[54] SCROLL TYPE FLUID DISPLACEMENT APPARATUS WITH IMPROVED FIXED SCROLL CONSTRUCTION

[75] Inventor: Masato Hasegawa, Gunma, Japan

[73] Assignee: Sanden Corporation, Gunma, Japan

[21] Appl. No.: 142,711

[22] Filed: Jan. 11, 1988

[30] Foreign Application Priority Data

Jan. 10, 1987 [JP] Japan ..... 62-1501[U]

[51] Int. Cl.[4] ..... F01C 1/04; F01C 21/10

[52] U.S. Cl. ..... 418/55; 29/156.4 R

[58] Field of Search ..... 418/55; 29/156.4 R

[56] References Cited

U.S. PATENT DOCUMENTS

| | | | |
|---|---|---|---|
| 3,924,977 | 12/1975 | McCullough | 418/55 |
| 3,994,635 | 11/1976 | McCullough | 418/55 |
| 4,065,279 | 12/1977 | McCullough | 418/55 |
| 4,395,205 | 7/1983 | McCullough | 418/55 |
| 4,437,820 | 3/1984 | Terauchi et al. | 418/55 |
| 4,453,899 | 6/1984 | Hiraga et al. | 418/55 |
| 4,527,963 | 7/1985 | Terauchi | 418/55 |
| 4,547,138 | 10/1985 | Mabe et al. | 418/55 |
| 4,627,799 | 12/1986 | Terauchi | 418/55 |
| 4,627,800 | 12/1986 | Matsudaira et al. | 418/55 |
| 4,645,436 | 2/1987 | Sakamoto | 418/55 |
| 4,701,115 | 10/1987 | Shimizu et al. | 418/55 |
| 4,722,676 | 2/1988 | Sugimoto | 418/55 |

FOREIGN PATENT DOCUMENTS

| | | | |
|---|---|---|---|
| 61-185693 | 8/1986 | Japan | 418/55 |

*Primary Examiner*—John J. Vrablik

*Attorney, Agent, or Firm*—Banner, Birch, McKie & Beckett

[57] ABSTRACT

A scroll type fluid displacement apparatus including an orbiting scroll and a fixed scroll, each having an end plate and a spiral element is disclosed. The spiral elements interfit at an angular and radial offset to form a plurality of line contacts between the spiral curved surfaces to define at least one pair of fluid pockets. A driving mechanism is operatively connected to the orbiting scroll for orbiting the orbiting scroll relative to the fixed scroll while preventing rotation of the orbiting scroll. This changes the volume of the fluid pockets. A plurality of threaded holes are formed through the end plate of the fixed scroll for attaching the fixed scroll to the inner end surface of projecting portions of the compressor housing. The projecting portions extend toward the fixed scroll and have threaded holes formed therein. A bolt is screwed through the fixed scroll holes and into the holes in the projecting portions to attach the fixed scroll to the housing.

9 Claims, 4 Drawing Sheets

SCROLL TYPE FLUID DISPLACEMENT APPARATUS WITH IMPROVED FIXED SCROLL CONSTRUCTION

TECHNICAL FIELD

The present invention relates to a scroll type fluid displacement apparatus. More particularly, the present invention relates to an improved construction for a fixed scroll of a scroll type fluid compressor.

BACKGROUND OF THE INVENTION

Scroll type fluid displacement apparatus are well known in the prior art. For example, U.S. Pat. No. 801,182 issued to Cruex discloses the basic construction of a scroll type fluid displacement apparatus. This apparatus includes two scrolls each having a circular end plate and a spiroidal or involute spiral element. The scrolls are maintained at an angular and radial offset so that both spiral elements interfit to form a plurality of line contacts between their curved surfaces to thereby seal off and define at least one pair of fluid pockets. The relative orbital motion of the two scrolls shifts the line contacts along the spiral curved surfaces and, as a result, the volume of the fluid pockets increases or decreases, dependent on the direction of the orbital motion. Thus, a scroll type fluid displacement apparatus may be used to compress, expand, or pump fluids.

Referring to FIG. 1, a conventional scroll type fluid compressor 1 includes a compressor housing 2 having a front end plate 3 mounted on a cup-shaped casing 4 by bolt 5. A fixed scroll 6 and an orbiting scroll 7 are placed in compressor housing 2. Fixed scroll 6 includes end plate 61, spiral element 62 which is formed on a front axial end surface of end plate 61, and projecting portion 63 which is formed on the opposing rear axial end surface of end plate 61. Projecting portion 63 includes dividing wall 631 and a plurality of shank portions 632. Projecting portion 63 is fixed on the inner wall surface of bottom portion 41 of cup-shaped casing 4 by bolts 8. Bottom portion 41 includes dividing wall 411 and shank portions 412. Bolts 8 are disposed through holes **412*a* in shank portions 412 and holes 632*a* in shank portions 632. End plate 61 of fixed scroll 6, which is secured to cup-shaped casing 4 as described above, divides the interior of cup-shaped casing 4 into rear chamber 42 and front chamber 43. Seal ring 9 seals between the outer surface of end plate 61 of fixed scroll 6 and the inner surface of cup-shaped casing 4**.

Orbiting scroll 7 includes end plate 71, spiral element 72 which is formed on a front axial end surface of end plate 71, and tubular bore 73 which is formed on the opposing rear axial end surface of end plate 71. Spiral element 72 interfits with spiral element 62 of fixed scroll 6 at an angular and radial offset to form a plurality of line contacts to seal off fluid pockets in a manner known in the art. Orbiting scroll 7 is coupled to drive shaft 10 which is rotatably supported within front end plate 3 through radial bearing 31. The drive mechanism which drives orbiting scroll 7 without rotation is known in the art. Examples can be found in U.S. Pat. Nos. 4,439,118 and 4,547,138.

When orbiting scroll 7 undergoes orbital motion, the fluid, which flows into a suction chamber in front chamber 43 from suction port 11 formed on cup-shaped casing 4, is taken into the fluid pockets formed between spiral elements 62 and 72. The fluid is gradually compressed as it is moved toward the center of the spiral elements. Compressed fluid at the center of the spiral elements exits into a discharge chamber formed in rear chamber 42 through discharge hole 611 formed through end plate 61 of fixed scroll 6. The compressed fluid is discharged out of compressor housing 2 through discharge port 12 formed on cup-shaped casing 4.

In the above compressor, threaded hole **632*a* is formed in shank portion 632 of projecting portion 63 to receive bolt 8 to fasten cup-shaped casing 4 to fixed scroll 6. A certain axial length for hole 632*a* and shank portion 632 is required to adequately secure cup-shaped casing 4 to fixed scroll 6. This axial length for shank portion 632 is larger than the required dimension which is needed to define a suitable discharge chamber. Thus, the axial length of compressor 1** becomes longer solely to accommodate this connection.

In addition, seal ring 13 is disposed between the outer surface of cup-shaped casing 4 and bolt 8 to prevent leakage of discharged gas from rear chamber 42 to the outside. However, when the discharged gas pressure is high gas nonetheless leaks from rear chamber 42 to the outside through a small gap adjacent seal ring 13, although the volume of this gas leakage is small.

FIG. 2 shows the rear axial end surface of a fixed scroll of a conventional scroll type fluid compressor. Fixed scroll 6 is originally made by casting. The rear axial end surface of end plate 61 and the axial end surface of projecting portion 63 are planed by cutting or machining. However, since surrounding area 612 of projecting portion 63, including dividing wall 631 and shank portion 632, cannot be finished by cutting, an unfinished casting surface still remains on the surface of surrounding area 612. The surface of surrounding area 612 is lower than the surrounding finished portions of end plate 61.

If valve retainer 14 and valve plate 15 were fixed to surrounding area 612, discharge hole 611, which is disposed on a higher, finished portion of end plate 61, would not be securely closed. Therefore, valve retainer 14 which limits the opening volume of valve plate 15 cannot be fixed on the unfinished surface of surrounding area 612. Valve retainer 14 and valve plate 15 must be fixed to a finished portion of the surface of end plate 61 by bolt 16. Valve retainer 14 and valve plate 15 must be fixed to the portion of the finished surface outside of projecting portion 63 as shown in FIG. 2. If valve retainer 14 and valve plate 15 were attached inside of projecting portion 63, their lengths would be very short. This increases the angle through which valve retainer 14 and valve retainer 15 must bend to open discharge hole 611 and significantly reduces their durability. Thus, valve retainer 14 and valve plate 15 must be fixed to the outer edge of end plate 61.

SUMMARY OF THE INVENTION

It is a primary object of the present invention to provide a scroll type fluid compressor with a fixed scroll having a relatively short axial length.

It is another object of the present invention to provide a scroll type fluid compressor with a fixed scroll construction which prevents leakage of fluid out of the compressor.

It is a further object of the present invention to provide a scroll type fluid compressor with a simple fixed scroll construction.

The scroll type fluid displacement apparatus, such as a compressor, according to the present invention includes a compressor housing having a plurality of projecting portions on an inner surface. An orbiting scroll and a fixed scroll each have an end plate and a spiral element which extends from one axial end surface of the end plate. The spiral elements interfit at an angular and radial offset to make a plurality of line contacts to define at least one pair of sealed off fluid pockets. A driving mechanism is operatively connected to the orbiting scroll to effect orbital motion of the orbiting scroll relative to the fixed scroll while preventing rotation of the orbiting scroll. This changes the volume of the fluid pockets. A plurality of threaded holes are formed through the end plate of the fixed scroll for attaching the fixed scroll to the inner end surface of the projecting portions. A plurality of threaded holes are formed in the projecting portions corresponding to the fixed scroll threaded holes. A bolt is screwed through each fixed scroll hole and into the corresponding threaded hole in the projecting portions.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
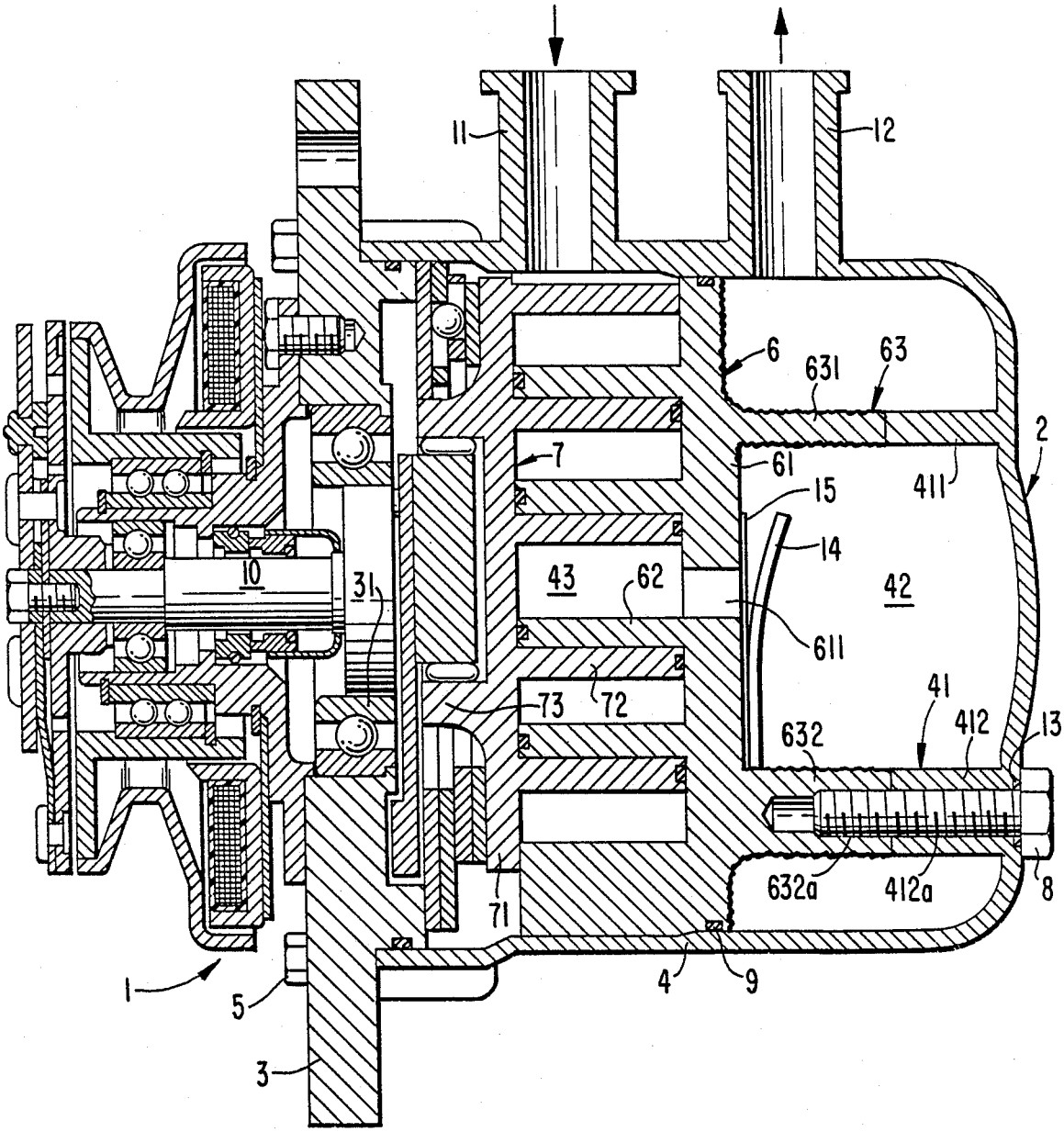
FIG. 1 PRIOR ART
FIG. 1 is a cross-sectional view of a conventional scroll type fluid compressor.
Figure 2:
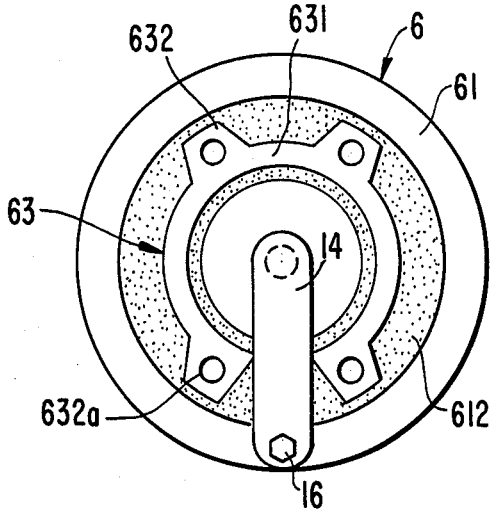
FIG. 2 PRIOR ART
FIG. 2 is a plane view of the fixed scroll of the compressor of FIG. 1.
Figure 3:
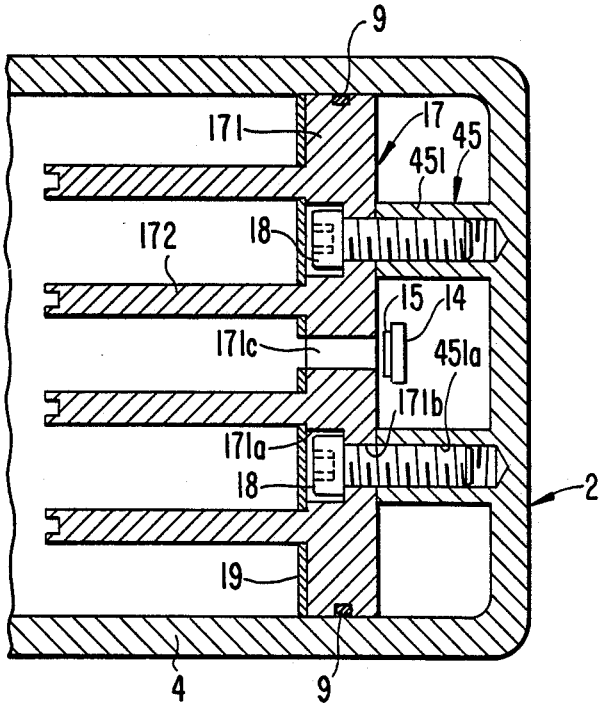
FIG. 3 is a partial cross-sectional view of a scroll type fluid compressor in accordance with one embodiment of the present invention.

FIG. 3 shows the construction of a fixed scroll in accordance with one embodiment of the present invention. The description of parts and constructions identical to those of the compressor shown in FIG. 1 is omitted; identical reference numerals designate identical elements.

Figure 5:
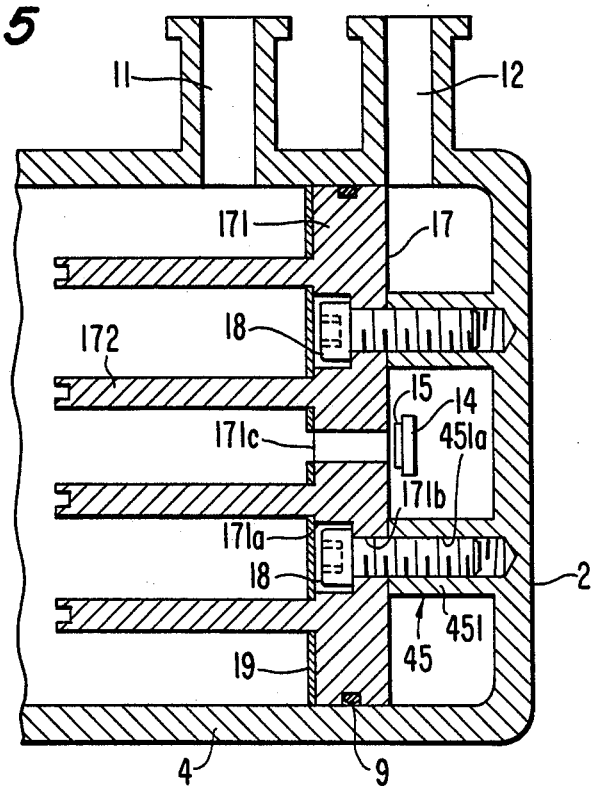
FIG. 5 is a partial cross-sectional view of the compressor of FIG. 3 showing the suction and discharge ports.
Figure 6:
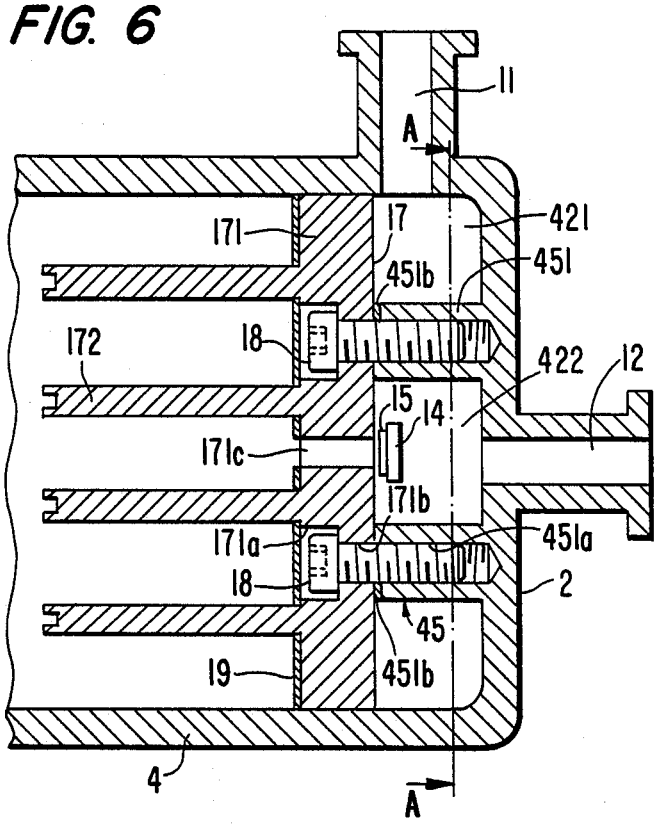
FIG. 6 is a partial cross-sectional view of the compressor of FIG. 3 showing alternate suction and discharge port locations.

An annular shaped partition wall 45 axially extends from the inner surface of the bottom portion of cup-shaped casing 4 and surrounds discharges hole 171*c* of fixed scroll 17. A plurality of shank portions 451 are equiangularly formed in partition wall 45. A threaded hole 451*a* is formed in each shank portion 451. In an alternate embodiment, partition wall 45 need not be formed and a plurality of shank portions 451 are independently and equiangularly formed on the inner surface of the bottom portion of casing 4.

Where shank portions 451 are independently formed, suction port 11 must be disposed on housing 2 on the front chamber side of end plate 71 as shown in FIG. 5. Discharge port 12 is mounted on housing 2 on the rear chamber side of end plate 71. Where shank portions 451 are part of partition wall 45, partition wall 45 forms a central space surrounded by a radially outer space. The central space and the radially outer space are sealed from each other to prevent fluid communication therebetween. In this embodiment the central space can serve as discharge chamber 422 and the radially outer space as suction chamber 421. Thus, both suction port 11 and discharge port 12 can be disposed on housing 2 on the rear chamber side of end plate 71 as shown in FIG. 6. Suction port 11 communicates with suction chamber 421 in the radially outer space which, in turn, communicates with an outer fluid pocket formed by spiral elements 72, 172. Discharge port 12 communicates discharge chamber in the central space.

Figure 7:
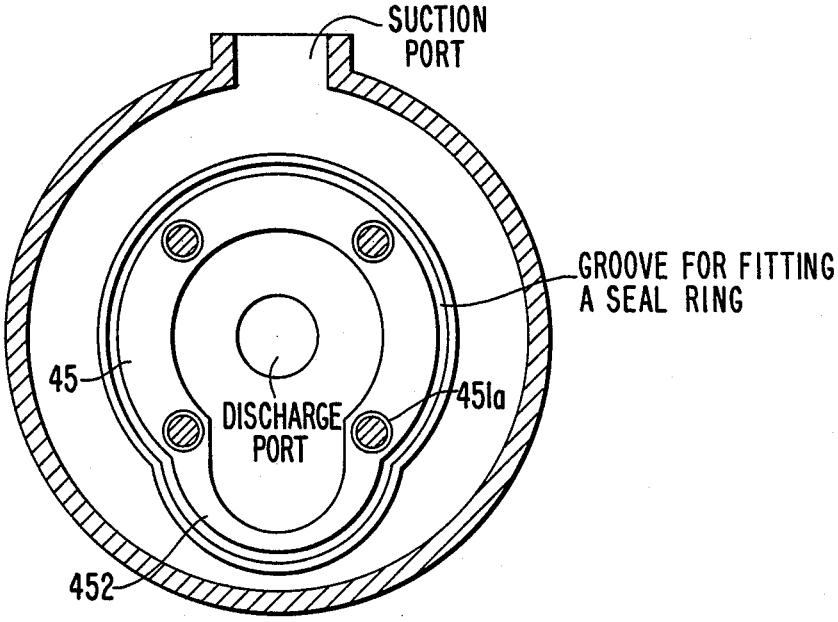
FIG. 7 is a sectional view of the compressor taken along line A—A of FIG. 6 illustrating one possible shape of the partition wall.

In the compressor of FIG. 6, partition wall 45 may embody any shape as long as suction chamber 421 is sealed off from discharge chamber 422. Partition wall 45 may take the shape shown in FIG. 7. This shape is substantially annular but has an extending portion 452 to accommodate placing bolt 16 within partition wall 45. Seal ring 451*b* is disposed between shank portion 451 and circular end plate 171.

Fixed scroll 17 includes a circular end plate 171 having opposing front and rear axial end surfaces and a spiral element 172 axially extending from the front axial end surfaces. A plurality of through holes 171*b* are formed totally through end plate 171 and align with threaded holes 451*a* of shank portions 451 of partition wall 45. The end opening of holes 171*b* which faces the front axial end surface has an enlarged portion 171*a*. The dimensions of enlarged portion 171*a* are larger than those of the head portions of bolts 18 disposed through holes 171*b* and enlarged portions 171*a* may be concave in shape. The width of end plate 171 is greater than that of end plate 61 to prevent weakening by the formation of enlarged portion 171*a*. Fixed scroll 17 is fixed on partition wall 45 of the inner end surface of the bottom portion of cup-shaped casing 4 by bolts 18 which are screwed into threaded holes 451*a* through holes 171*b* of end plate 171.

A bottom end plate 19 is disposed on the front axial end surface of end plate 171 and covers the portion of the front axial end surface of end plate 171 between spiral element 172. The enlarged portions 171*a* of holes 171*b* are also covered. Bottom plate 19 prevents blow-by gas from accumulating within enlarged portions 171*a* of holes 171*b*. However, if enlarged portions 171*a* of holes 171*b* are small, bottom plate 19 is not necessary as significant quantities of blow-by gas will not accumulate.

Figure 4:
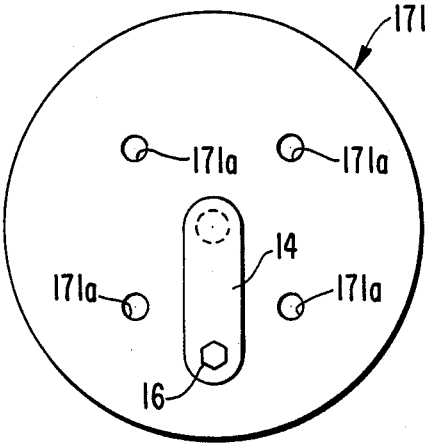
FIG. 4 is a plane view of the fixed scroll of the compressor of FIG. 3.

As explained above, the rear axial end surface of end plate 171 faces rear chamber 42 and is formed as a flat surface, as shown in FIG. 4. Therefore, finishing of the rear axial end surface by cutting is a simple operation. The fixed position of valve retainer 14 on the rear axial end surface of end plate 171 by bolt 16 is freely selectable in accordance with the configuration of discharge valve plate 15 and valve retainer 14.

Numerous characteristics, advantages, and embodiments of the invention have been described in detail in the foregoing description with reference to the accompanying drawings. However the disclosure is illustrative only and the invention is not limited to the precise illustrated embodiments. Various changes and modifications may be effected therein by one skilled in the art without departing from the scope or spirit of the invention.

I claim:

1. In a scroll type fluid displacement apparatus including a housing, a suction port and a discharge port disposed on said housing, and an orbiting scroll and a fixed scroll each having a circular end plate having opposite front and rear axial end surfaces and a spiral element extending from said front axial end surface, said rear axial end surface of said circular end plate of said fixed scroll and said housing forming a rear chamber, said scrolls forming a front chamber between their respective said circular end plates, said scrolls being maintained at an angular and radial offset so that said spiral elements interfit to form a plurality of line contacts between their curved surfaces to thereby seal off and define at least one pair of fluid pockets, a driving mechanism operatively connected to said orbiting scroll to effect relative orbital motion with respect to said fixed scroll while preventing rotation of said orbiting scroll to thereby change the volume of the fluid pockets, and said housing having a plurality of projecting portions formed on the inner end surface of said housing and extending toward said fixed scroll, the improvement comprising:

a plurality of first holes formed completely through said circular end plate of said fixed scroll for attaching said fixed scroll to said housing, a second hole formed in each of said projecting portions, each said second hole corresponding to a respective said first hole, a bolt screwed into each said second hole through each respective said first hole to attach said fixed scroll to said housing, wherein said bolts pass through said circular end plate from said front axial end surface to said rear axial end surface, and wherein said rear axial end surface is substantially flat.

2. The scroll type fluid displacement apparatus according to claim 1 wherein said first and second holes are equiangularly disposed around said apparatus.

3. This scroll type fluid displacement apparatus according to claim 1 wherein said first holes have an enlarged portion adjacent said front axial end surface of said circular end plate of said fixed scroll to accommodate said bolts so that said bolts do not extend to said front axial end surface.

4. The scroll type fluid displacement apparatus according to claim 1 further comprising a bottom end plate disposed on said front axial end surface of said circular end plate of said fixed scroll between said spiral element to cover said first holes.

5. The scroll type fluid displacement apparatus according to claim 1 further comprising a valve retainer for a valve plate of a discharge hole of said fixed scroll, and said valve retainer and said valve plate are attachable to said rear axial end surface of said fixed scroll anywhere along the radius of said fixed scroll.

6. The scroll type fluid displacement apparatus according to claim 1 wherein said discharge port is disposed on said housing in fluid communication with said rear chamber and said suction port is disposed on said housing in fluid communication with said front chamber.

7. The scroll type fluid displacement apparatus according to claim 1 wherein said projecting portions of said housing are connected to each other by a partition wall.

8. The scroll type fluid displacement apparatus according to claim 7 wherein said partition wall divides said rear chamber into a radially inner central space and a radially outer space, wherein said central space and said outer space are sealed from each other to prevent fluid communication therebetween, said central space serves as a discharge chamber and said outer space serves as a suction chamber, wherein said discharge port is disposed on said housing in fluid communication with said discharge chamber and said suction port is disposed on said housing in fluid communication with said suction chamber.

9. The scroll type fluid displacement apparatus according to claim 7 wherein said discharge port is disposed on said housing in fluid communication with said rear chamber and said suction port is disposed on said housing in fluid communication with said front chamber.

* * * * *